United States Patent [19]

Palinkas

[11] 4,298,201

[45] Nov. 3, 1981

[54] GOLF ALIGNMENT DEVICE

[76] Inventor: Bernard Palinkas, 1017 Brunswick Pike, Lawrenceville, N.J. 08648

[21] Appl. No.: 213,139

[22] Filed: Dec. 4, 1980

[51] Int. Cl.[3] ..... A63B 69/36

[52] U.S. Cl. ..... 273/183 B; 273/187 R; 273/186 C

[58] Field of Search ..... 273/183 B, 183 E, 186 C, 273/183 A, 190 R, 190 A, 187 R; 2/185 R

[56] References Cited

U.S. PATENT DOCUMENTS

| | | | |
|---|---|---|---|
| 1,169,188 | 1/1916 | Peck | 273/183 B X |
| 2,750,195 | 6/1956 | Ching | 273/183 A |
| 2,992,005 | 7/1961 | Lockhart | 273/183 A |
| 3,332,688 | 7/1967 | Gevertz | 273/186 C |
| 3,437,339 | 4/1969 | Starck | 273/183 B |
| 3,860,247 | 1/1975 | Taylor | 273/186 C |
| 3,868,116 | 2/1975 | Ford | 273/186 C |

*Primary Examiner*—George J. Marlo
*Attorney, Agent, or Firm*—Frederick A. Zoda; John J. Kane; Albert Sperry

[57] ABSTRACT

A golf alignment device usable for correct placement of the body and golf club of a golfer with respect to a golf ball upon the execution of a golf swing which includes a retaining clip for holding the device in a detachably fixable fashion to the hat or headband or glasses of the golfer. The retaining clip is secured to a linkage assembly which is generally universally movable to facilitate orientation of a bar member which is secured to the bottom of this linkage and thereby movably secured with respect to the golfer. This bar member is adapted to extend longitudinally in the direction of the golf swing and is preferably triangular in cross-section. The bar member is capable of rotation about its longitudinally extending axis with respect to the linkage in order to vary the area of the bar member facing the golfer. Each of these various faces or sides preferably is of a different color in order to facilitate viewing of this alignment tool with different backgrounds such as green grass, sand traps, fallen leaves or other backgrounds which a golfer normally encounters. A longitudinally slidable collar as well as a plurality of graduation markings may be included on the bar member to facilitate alignment and swing correction.

9 Claims, 4 Drawing Figures

10
12
13
14
16
18
20
22
24
26
28
30
32
34
36
38
40
42
44
46
48
50
52
54
56

GOLF ALIGNMENT DEVICE

BACKGROUND OF THE INVENTION

1. Field of the Invention

The present invention deals with the field of devices usable for the improvement of golf swings. A great deal of money is spent every year by golfers attempting to improve their golf swing and most of this money is unnecessarily used for extensive lessons which merely attempt to repetitively engrain the proper habits of swinging a golf club. The present invention provides a simple, expedient device which is uncomplicated and convenient to enhance the learning of these repetitive habits by the average golfer. This device is particularly usable in that it has usefulness for all types of golf strokes including driving, long irons, short irons, pitching, chipping, and putting.

2. Description of the Prior Art

Many devices have been designed for the improvements of golf swings. Such devices have been disclosed in U.S. Pat. Nos. 2,750,195; 2,992,005; 3,332,688; 3,437,339; 3,860,247; and 3,868,116. None of these devices includes the longitudinally extending rod for maintaining proper orientation of the approach and follow-through as present in the applicant's design. These devices merely indicate head movement or include an apparatus which is placed upon the ground overwhich a golfer should stroke to maintain club alignment. Such a device is obviously not usable when actually playing the game of golf, however, the apparatus of the present invention is indeed usable in this fashion.

SUMMARY OF THE INVENTION

The present invention provides a golf alignment device which is particularly usable by golfers for maintaining proper orientation of his golf club and body with respect to a golf ball during the execution of a golf stroke. This device preferably includes a retaining means which is attachable with respect to the body of a golfer. This retaining means preferably takes the form of a clip with spring biased jaws which are adapted to hold the golf device with respect to the body of a golfer. It is preferable that this clip means is adapted to be clipped on the brim of a hat or sun visor of the golfer or on that golfer's glasses or sweat band. The jaws are preferably spring biased into a closed position by a compression spring means or expandable spring means appropriately placed with respect to the jaws.

This alignment device further includes a linkage means which is secured to the retaining means such as by an attachment means wherein at least a portion of this linkage means is adapted to be movable with respect to the retaining means. The linkage means preferably includes a first link means which is fixedly secured with respect to the retaining means and extends outwardly and downwardly therefrom. Also, the linkage means perferably includes a second link means which is possibly movably secured to the first link means but is indeed fixedly secured to the bar member to allow rotatable movement thereof with respect to the first link means. Furthermore, an adjustment means is provided connecting the first link means to the second link means which allows complete freedom of movement with respect to one another. Preferably this adjustment means takes the form of a ball and socket connection.

A securement means such as a clamp is provided between the second link of the linkage means and the bar member. This securement means preferably allows rotational movement of the bar member along its longitudinal axis with respect to the linkage to vary the surface of the bar member being viewed by the user.

The bar member preferably is of a triangular cross-section and is movably secured with respect to the linkage means by the securement means. The bar member extends longitudinally and includes at least a first side and a second side but often will include a third side each having a different coloration to facilitate viewing of these sides with respect to the backgrounds of different color shades by varying the upwardly facing color. The bar member may preferably further include a plurality of graduation marking therealong to facilitate judgement of distance and particularly to facilitate the judgement of the amount of backswing necessary during putting.

The alignment device of the present invention further includes a collar means extending laterally around the bar member to facilitate orientation of the golf club with respect to the body of a golfer. The collar means is longitudinally movable with respect to the bar member therealong to vary the orientation for different types of golf club strokes.

It is an object of the present invention to provide a golf alignment device for use by a golfer in the correct placement of his golf club and body with respect to a golf ball during the execution of a golf swing.

It is an object of the present invention to provide a golf alignment device which is simple and inexpensive in basic design.

It is an object of the present invention to provide a golf alignment device which is usable during the actual playing of a game of golf.

It is an object of the present invention to provide a golf alignment device which provides a longitudinally extending bar for maintaining correct orientation between the arms, golf club, and golf ball during the execution of a golf stroke.

It is an object of the present invention to provide a golf alignment device which includes a collar means movably positioned longitudinally along a longitudinally extending bar such as to be orientatable with respect to a golf ball to maintain proper foot position of a golfer.

It is an object of the present invention to provide a golf alignment device which includes a universal adjustment link such as a ball socket configuration to allow complete freedom of movement between a longitudinally extending alignment bar means and the golfer.

It is an object of the present invention to provide a golf alignment device particularly usable for a golfer in maintaining proper orientation between his golf club and golf ball during the execution of a golf swing which includes a plurality of sides on the bar member each having a varied coloration in order to facilitate viewing against various different hues of background.

It is an object of the present invention to provide a golf alignment device for use by a golfer particularly during the execution of putting strokes which includes graduation markers to correctly determine the amount of backswing necessary.

It is an object of the present invention to provide a golf alignment device for use by a golfer when looking down at his shoes to give a proper stance while at the same time allows looking down at the ball to give the correct orientation for swing at the ball.

It is an object of the present invention to provide a golf alignment device which can be made as a single unit as to be put on and taken off at any time on the golf course, practice range or putting range as desired by the golfer.

It is an object of the present invention to provide a golf alignment device for use by a golfer for correct placement of his golf club and body with respect to a golf ball during the execution of a swing which keeps the golfer's head down until the ball is actually contacted during driving, pitching, or putting.

It is an object of the present invention to provide a golf alignment device which swivels in order to allow a stance to be corrected inside to outside or outside to inside to correct an improper golf habit such as slicing or hooking.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figures 1, 2, 3, 4:
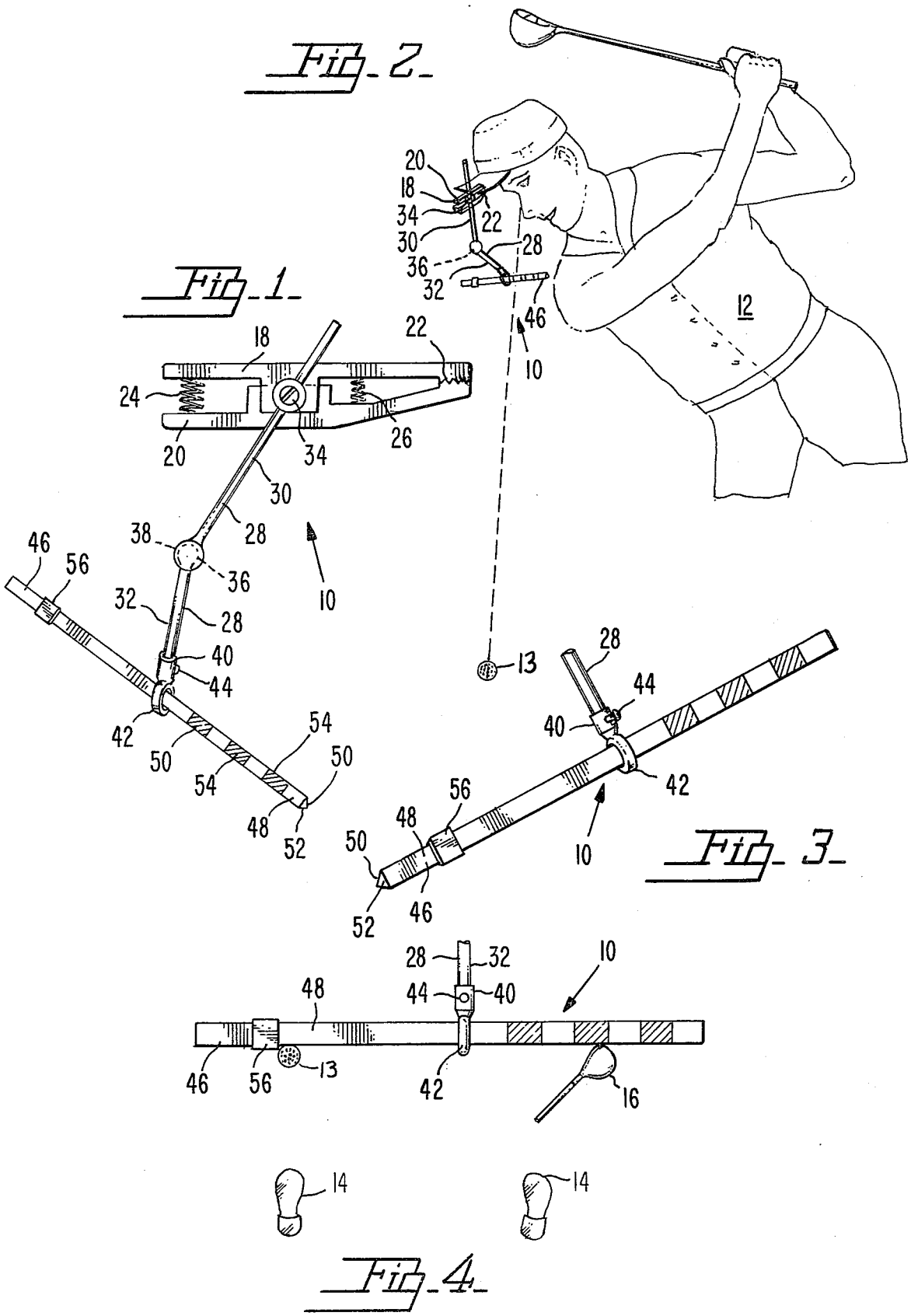
FIG. 1 is a perspective of an embodiment of the golf alignment device of the present invention.
FIG. 2 is a perspective illustration of an embodiment of a golf alignment device of the present invention shown in position attached to the brim of a golf hat of a golfer.
FIG. 3 is a close-up perspective illustration of an embodiment of a bar member of an embodiment of a device of the present invention.
FIG. 4 is a perspective view of an embodiment of a golf alignment device of the present invention as would be seen by a golfer when looking downwardly at his shoes, golf club and golf ball.

The present invention provides a golf alignment device 10 for use by golfers 12 in the correct alignment between a golf ball 13, the golfer's feet 14 and the approaching golf club 16. As shown in FIG. 4 the correct alignment of these devices can be more properly maintained when coordinated with respect to the bar member 46 of the present invention.

The device 10 includes a retaining means 18 which may take the form of a clip means 20 which is particularly adapted to be secured with respect to the clothing or other wearing apparel of a golfer such as the brim of a golfing hat, the brim of a sun visor, a hat band, sweat band, eye glasses or sun glasses. The clip means 20 preferably includes a jaw means 22 adapted to grasp the wearing apparel as described. To facilitate closing of the jaws 22 about the respective apparel a compression spring means 24 or an expandable spring means 26 may be properly oriented within the clip means 20.

The retaining means 18 provides the mounting for a linkage means 28 which extends preferably downwardly and outwardly therefrom. The linkage means 28 may comprise a plurality of actual link members, however, it must include at least a first link means 30 and a second link means 32. The first link means 30 is attached by an attachment means 34 with respect to the retaining means 18 to maintain the orientation therebetween. An adjustment means 36 is provided between the first link means and the second link means to allow adjustable positioning of the second link means with respect to the first link means and with respect to the retaining means 18. This adjustment means 36 preferably for complete universal movement will be a ball and socket configuration 38.

A securement means 40 is provided for securing the bar member 46 with respect to the linkage means 28 and preferably with respect to the second link means 32. In this manner by the inclusion of the adjustment means 36 the bar member 46 will be universally movable with respect to the retaining means 18 and therefore with respect to the golfer 12. The securement means 40 preferably takes the form of a clamp means 42 which may include a set screw 44 therein for fixed securement of the clamp means 42 with respect to the second link means 32. In this manner the bar member will be provided extending in a longitudinal fashion but being capable of a myriad of possible orientation.

Preferably the bar member is a longitudinally extending rod-like member having a triangular cross-section. The cross-section actually can be of any shape, and even could be round, but it should include a first side 48 and a second side 50. These two sides can merely be the two opposite halves of a circular rod or two opposite sides of a square rod. In either configuration the first side 48 and the second side 50 should be of opposite colorations such as to be yieldable with respect to a large variety of differently colored backgrounds. With a triangular cross-section for the bar member 46 a third side 52 will be provided which preferably is of even a further different coloration. For example, the first side may be green for viewing against sand traps whereas the second side 50 may be brown for viewing against grass and the third side can be white for viewing against ground that is covered with leaves or a dirt area. Regardless, it is preferable that the bar member 46 be rotatably movable about its longitudinal axis while held by the clamp means 42 or the securement means 40. In this manner each of the first side 48 and second side 50 and third side 52 can be selectively caused to be in viewing area of the golfer to facilitate his usage of the longitudinal alignment aspects of the bar member 46.

A plurality of graduation markings 54 should be preferably included along one end of the bar member 46 to provide a rough estimate of distance as well as to provide a guide for the distance in the rearward direction which a golf club should be swung in order to hit the golf ball within a given distance. These graduation markings 54 are particularly usable in putting where the backstroke will be short enough to still be within the viewing areas of the golfer. In this area an increase in distance can be achieved by having a golf stroke go back one graduation marker further than a previous similar shot as performed earlier. In this manner a golfer can learn the speed of the greens and the incline or decline of the terrain as another aspect with respect to the amount of backswing necessary.

A collar means 56 is also provided which is usable in order to orient the ball with respect to the left foot of the golfer. This collar means is also usable to vary or correct the distance between the ball and the individual graduation markings 54. Furthermore, the collar means 56 is preferably movable in a longitudinal direction along the bar member 46 in order to vary the distance necessary for hitting different types of shots such as driving, long irons, short irons, chipping, pitching, or putting.

The present invention thereby provides a novel device wherein a bar member is used for correct longitudinal alignment for a golfer. This bar member is maintained in the orientation and is selectively movable in any direction as a result of the linkage means connecting it with respect to the golfer. The alignment device is also usable during the actual playing of a game of golf since it is lightweight and capable of movement out of the viewing area when not used if necessary. The device can be flipped up out of the way like certain types of upwardly flippable sun glasses.

While particular embodiments of this invention have been shown in the drawing and described above, it will be apparent, that many changes may be made in the form, arrangement and positioning of the various element of the combination. In consideration thereof it should be understood that preferred embodiments of this invention disclosed herein are intended to be illustrative only and not intended to limit the scope of the invention.

I claim:

1. A golf alignment device, for use by a golfer for correct placement of his golf club and body with respect to a golf ball upon execution of a golf swing, comprising:

(a) a retaining means being attachable with respect to the body of a golfer;

(b) a linkage means attached to said retaining means having at least a portion thereof being movable with respect to said retaining means;

(c) an attachment means connected to said retaining means and said linkage means for attachment therebetween;

(d) a securement means being secured to said linkage means;

(e) a bar member being secured to said securement means to be movably attached with respect to said linkage means, said bar member extending longitudinally and including at least a first side and a second side being of different colorations to facilitate viewing against backgrounds of different color shades, said bar member being rotatably movable about the longitudinally extending axis thereof with respect to said linkage means to selectively orient one of said first and second sides in the upwardly facing direction, said bar member further including a plurality of graduation markings extending therearound to facilitate judgement of distance; and (f) a collar means extending laterally around said bar member to facilitate orientation of a golf ball with respect to the body of a golfer, said color means being longitudinally movable with respect to said bar member to vary the orientation for different types of golf club strokes.

2. The device as defined in claim 1 wherein said bar member is triangular in cross-section and includes a third side of different coloration than said first side and said second side, said graduation markings extending over said third side.

3. The device as defined in claim 1 wherein said securement means comprises a clamp means fixedly secured with respect to said linkage means and attached to said bar member in a movable manner to allow said bar member axial rotatable movement.

4. The device as defined in claim 1 wherein said linkage means further comprises:

(a) a first link means fixedly secured with respect to said retaining means and extending outwardly and downwardly therefrom;

(b) a second link means fixedly secured to said bar member to allow rotatable movement thereof and movably connected to said first link means; and (c) an adjustment means connecting said first link means to said second link means and allowing complete freedom of movement with respect to one another.

5. The device as defined in claim 4 wherein said adjustment means is a ball and socket connection.

6. The device as defined in claim 1 wherein said retaining means comprises a clip means and a jaw means adapted to hold said linkage means with respect to the body of a golfer.

7. The device as defined in claim 6 wherein said jaw means are spring-biased into a closed position by a compression spring means.

8. The device as defined in claim 6 wherein said jaw means are spring-biased into a closed position by an expandable spring means.

9. A golf alignment device, for use by a golfer for correct placement of his golf club and body with respect to a golf ball upon execution of a golf swing, comprising:

(a) a retaining means being attachable with respect to the body of a golfer, said retaining means comprising a clip means and a jaw means adapted to hold said linkage means with respect to the body of a golfer, said retaining means further including a spring means adapted to bias said jaw means into a closed position;

(b) a linkage means attached to said retaining means having at least a portion thereof being movable with respect to said retaining means, said linkage means further comprising:

1. a first link means fixedly secured with respect to said retaining means and extending outwardly and downwardly therefrom;
2. a second link means movably connected to said first link means; and
3. an adjustment means connecting said first link means to said second link means and allowing complete freedom of movement with respect to one another;

(c) an attachment means connected to said retaining means and to said first link means of said linkage means for attachment therebetween;

(d) a clamp means being secured to said second link means of said linkage means;

(e) a bar member of triangular cross-section being secured to said clamp means to be movably attached with respect to said second link means of said linkage means, said bar member extending longitudinally and including at least a first side, a second side and a third side each being of different colorations to facilitate viewing against backgrounds of different color shades, said bar member being rotatably movable about the longitudinally extending axis thereof with respect to said second link means of said linkage means to selectively orient one of said first, second and third sides in the upwardly facing direction, said bar member further including a plurality of graduation markings extending therearound to facilitate judgement of distance; and (f) a collar means extending laterally around said bar member to facilitate orientation of a golf ball with respect to the body of a golfer, said collar means being longitudinally movable with respect to said bar member to vary the orientation for different types of golf club strokes.

* * * * *